US012213591B1

(12) United States Patent
Omile, Jr.

(10) Patent No.: US 12,213,591 B1
(45) Date of Patent: Feb. 4, 2025

(54) PORTABLE FURNITURE

(71) Applicant: theCut Inc., Dover, DE (US)

(72) Inventor: Obi Omile, Jr., Dover, DE (US)

(73) Assignee: THECUT INC., Dover, DE (US)

( * ) Notice: Subject to any disclaimer, the term of this patent is extended or adjusted under 35 U.S.C. 154(b) by 0 days.

(21) Appl. No.: 18/788,522

(22) Filed: Jul. 30, 2024

(51) Int. Cl.

| | |
|---|---|
| ***A47C 1/034*** | (2006.01) |
| ***A47C 1/024*** | (2006.01) |
| ***A47C 1/037*** | (2006.01) |
| ***A47C 1/06*** | (2006.01) |
| ***A47C 1/11*** | (2006.01) |
| ***A47C 3/30*** | (2006.01) |
| ***A47C 4/02*** | (2006.01) |
| ***A47C 4/04*** | (2006.01) |
| ***A47C 4/28*** | (2006.01) |

(Continued)

(52) U.S. Cl.

CPC ..... *A47C 1/0244* (2013.01); *A47C 1/024* (2013.01); *A47C 1/0242* (2013.01); *A47C 1/0342* (2013.01); *A47C 1/037* (2013.01); *A47C 1/06* (2013.01); *A47C 1/11* (2013.01); *A47C 3/30* (2013.01); *A47C 4/02* (2013.01); *A47C 4/021* (2013.01); *A47C 4/04* (2013.01); *A47C 4/28* (2013.01); *A47C 7/004* (2013.01); *A47C 7/006* (2013.01); *A47C 7/008* (2013.01); *A47C 7/38* (2013.01); *A47C 7/5066* (2018.08)

(58) Field of Classification Search

CPC ..... A47C 1/0244; A47C 1/024; A47C 1/0242; A47C 1/0342; A47C 1/037; A47C 1/06; A47C 1/11; A47C 3/30; A47C 4/02; A47C 4/021; A47C 4/04; A47C 4/28; A47C 7/004; A47C 7/006; A47C 7/008; A47C 7/38; A47C 7/5066

USPC ... 297/17, 19, 183.1, 183.2, 344.19, 354.12, 297/440.15, 440.16, 440.22, 440.24, 297/451.8, 378.1, 461, 423.3, 423.4, 297/423.26

See application file for complete search history.

(56) References Cited

U.S. PATENT DOCUMENTS 1,398,253 A * 11/1921 Blando ..... A47C 17/82 5/618
2,618,313 A * 11/1952 Piotraschke ..... A47C 1/06 297/323

(Continued)

FOREIGN PATENT DOCUMENTS

WO 2002056734 A1 7/2002

*Primary Examiner* — Robert Canfield
(74) *Attorney, Agent, or Firm* — Davé Law Group, LLC; Raj S. Davé

(57) ABSTRACT

Embodiments relate to apparatus comprising a seat, a base for supporting the seat, and a mounting bracket connecting the seat and the base, wherein the mounting bracket comprises a first portion, a second portion and a flexible joint joining the first portion and second portion; the first portion connected to the base via a first connection member; the second portion is received by a seat comprising a receiving member, wherein the receiving member is connected to the seat using a second connection member; wherein the second portion moves between a foldable position and a release position relative to the first portion; wherein the mounting bracket is configured to be locked in foldable position securing the seat to the base; and wherein the mounting bracket is configured to be in release position for assembly and disassembly of the seat from the base.

20 Claims, 19 Drawing Sheets

(51) Int. Cl.

| | |
|---|---|
| ***A47C 7/00*** | (2006.01) |
| ***A47C 7/38*** | (2006.01) |
| ***A47C 7/50*** | (2006.01) |

(56) References Cited

U.S. PATENT DOCUMENTS

| | | | | |
|---|---|---|---|---|
| 3,235,305 | A | 2/1966 | Dlouhy et al. | |
| 3,674,308 | A * | 7/1972 | Radding | A47C 1/11 297/344.21 |
| 5,489,140 | A | 2/1996 | Van Horn-Plato | |
| 5,505,524 | A * | 4/1996 | Drumwright | A47C 7/004 297/183.5 |
| 6,079,786 | A * | 6/2000 | Kirkland | B63B 29/06 248/416 |
| 6,655,732 | B1 | 12/2003 | LaPointe | |
| 8,016,089 | B1 * | 9/2011 | McNichols | A45C 5/14 190/18 R |
| 8,573,454 | B2 * | 11/2013 | Talavera Tolentino | A45F 4/02 224/155 |
| 8,777,306 | B2 * | 7/2014 | Rahm | A47C 7/50 280/47.25 |
| 11,622,630 | B2 * | 4/2023 | Williams | A47C 1/06 297/71 |
| 12,059,074 | B2 * | 8/2024 | Chapman | A45C 13/262 |
| 2006/0273642 | A1 * | 12/2006 | Lin | B60N 2/01516 297/275 |
| 2023/0346123 | A1 * | 11/2023 | Gibson | A47C 4/02 |
| 2024/0306864 | A1 * | 9/2024 | Dodge | A47K 13/005 |

* cited by examiner

PORTABLE FURNITURE

FIELD OF INVENTION

This disclosure relates to portable furniture, and more particularly to a chair or a multi-functional treatment chair for seating a subject, which is easy to assemble, disassemble, and carry.

BACKGROUND

In this section prior art is cited.

"Treatment providers will thus typically furnish their business premises with specialized adjustable treatment chairs designed to meet their requirements. However, a treatment provider who provides their services away from their premises, such as in a home or office, may not have the use of a specialized chair: there is unlikely to be such a chair at the treatment location, and a chair cannot be brought from their professional premises since they are usually permanent fixtures, and are also both large and heavy (e.g. a typical barber's chair may have a mass of 60-70 kg). In these circumstances, the provider will need to make do with what is available at the treatment location, such as a kitchen stool, office chair, or dining chair. However, this can present problems for the treatment provider, not only in terms of the inconvenience of not being able to correctly position the subject, but also for their physical wellness. For example, a treatment provider may treat a number of different subjects over a number of hours in different locations, and if the provider needs to stretch or stoop to perform the treatment due to the subject being incorrectly positioned then they may consequently suffer physical strains." [US Patent Application Publication US20230346123A1 titled, "Assemblage for forming a treatment chair"]

"In barber and like chairs wherein the customer or occupant is being treated it is desirable to have the treating tools close at hand such as being held in a tool rack. It is desirable because of the requirements of the sanitation laws and for other reasons to maintain the tools sterilized. For example, in a barber chair if the clipper and combs are within the reach of the barber, and are positioned in a support which automatically sterilizes them between use, the time and effort saved by the barber in not having to walk to an adjoining counter or piece of furniture where the tools are kept is considerable and it is very useful for the barber to be able to easily lay down and pick up the tools for very brief use. It has heretofore been difficult to provide a handy tool support which is not in the way of the barber and does not inhibit his walking around the chair or does not prevent rotation of the chair. With the development of structures which permit bringing electrical power to the rotatable and elevatable chair top, it is possible to have electrically operating equipment such as clippers carried with the chair." [U.S. Pat. No. 3,235,305A titled, "Barber chair with sterilizer"]

"Because of increasing numbers of home-confined elderly women and working women, there is an increasing need for in-home beautician service. The number of elderly women crippled with arthritis and other causes is increasing, as is the number of those who are convalescing. Still further, because of greater longevity, more and more elderly women are infirm. These women tend to become depressed and bored, emphasizing the need for in-home beautician service as a means for "lifting their spirits"." [U.S. Pat. No. 5,489,140A titled, "Portable beautician's chair"]

"While many conventional reclining chairs operate satisfactorily, furniture manufacturers are continually striving to develop improved frames and actuation mechanisms for reducing system complexity and smoothness of operation as well as occupant comfort. Furthermore, there is a continuing desire to develop improved fabrication and assembly techniques which will result in reduced costs while promoting increased efficiency and improved product quality." [U.S. Pat. No. 6,655,732B1 titled, "Multiple position leg rest mechanism for a reclining chair"]

Therefore, there is a need for a chair which can be easily disassembled, transported from one treatment location to another and quickly reassembled in situ.

SUMMARY

The following presents a summary to provide a basic understanding of one or more embodiments described herein. This summary is not intended to identify key or critical elements or delineate any scope of the different embodiments and/or any scope of the claims. The sole purpose of the summary is to present some concepts in a simplified form as a prelude to the more detailed description presented herein.

According to an embodiment, disclosed is an apparatus comprising, a seat, a base for supporting the seat; and a mounting bracket connecting the seat and the base; wherein the mounting bracket comprises a first portion, a second portion and a flexible joint joining the first portion and second portion; the first portion connected to the base via a first connection member; the second portion is received by a seat comprising a receiving member, wherein the receiving member is connected to the seat using a second connection member; wherein the second portion moves between a foldable position and a release position relative to the first portion; wherein the mounting bracket is configured to be locked in foldable position securing the seat to the base; and wherein the mounting bracket is configured to be in release position for assembly and disassembly of the seat from the base; and wherein the seat is configured to be assembled to the base in an upright position by a user.

According to an embodiment of the apparatus, the apparatus is a chair.

According to an embodiment of the apparatus, the first portion is configured to be a first plate.

According to an embodiment of the apparatus, the second portion is configured to be a second plate.

According to an embodiment of the apparatus, the receiving member is in a U-groove to receive the second plate.

According to an embodiment of the apparatus, the flexible joint joining the first portion and second portion comprises a hinge joint.

According to an embodiment of the apparatus, the first portion and second portion are lockable using a mechanical locking mechanism.

According to an embodiment of the apparatus, the first portion and second portion are lockable using a magnetic locking mechanism.

According to an embodiment of the apparatus, the base comprises a hydraulic spring configured for height adjustment forming a hub and one or more legs.

According to an embodiment of the apparatus, the legs are foldable.

According to an embodiment of the apparatus, the legs are lockable using a spring loaded pin joint.

According to an embodiment of the apparatus, the legs are lockable using a snap joint.

According to an embodiment of the apparatus, the legs comprise feet of the apparatus which are configured for leveling the apparatus on a floor.

According to an embodiment of the apparatus, the apparatus further comprises a backrest, a headrest, and a footrest.

According to an embodiment of the apparatus, the backrest is adjustable to one or more reclining positions with respect to the base using a gas spring.

According to an embodiment of the apparatus, the backrest is foldable on to the seat to form a closed position.

According to an embodiment of the apparatus, the backrest is foldable on to the seat and lockable in the closed position.

According to an embodiment of the apparatus, the headrest is adjustable to one or more height positions using a leaf spring mechanism.

According to an embodiment of the apparatus, the footrest is adjustable to one or more positions using a spring-loaded pin to lock the footrest in multiple positions.

According to an embodiment of the apparatus, the seat comprises one or more wheels.

According to an embodiment of the apparatus, the seat is configured to swivel with respect to the base.

According to an embodiment of the apparatus, the base is covered using a base skirt, wherein the base skirt is configured to protect the base from dust and hair trimmings.

According to an embodiment of the apparatus, the base skirt is detachable.

According to an embodiment, disclosed is an apparatus comprising a seat, a backrest, a base, a footrest, and one or more wheels; the seat comprising a first side configured for a user to sit, and a second side comprising a receiving member for receiving a second portion of a mounting bracket, wherein the mounting bracket comprises a first portion connected to the base and the second portion that moves between a foldable position and a release position relative to the first portion; the backrest engaging with the seat such that the backrest is independently reclinable with respect to the seat and being foldable onto the first side of the seat to form a folded position and lockable in the folded position; the footrest connected to the seat at a first position configured to receive feet of the user when seated; the wheels connected to at least one of the seat and the backrest at a second position, wherein the second position is at opposite side of the first position such that the footrest is configured to be used as a handle while the wheels are configured to support the weight of the apparatus and facilitate transportability of the system.

According to an embodiment of the apparatus, the apparatus is a chair.

According to an embodiment of the apparatus, the backrest is reclinable in one or more positions with respect to a base using a gas spring.

According to an embodiment of the apparatus, the headrest is adjustable in one or more positions using a leaf spring mechanism.

According to an embodiment of the apparatus, the footrest is adjustable in height and angle using a spring-loaded pin to lock the footrest in multiple positions.

According to an embodiment of the apparatus, the seat is configured to swivel with respect to the base.

According to an embodiment of the apparatus, the base comprises a hydraulic spring configured for height adjustment forming a hub comprising one or more legs configured for adjustment of the seat.

According to an embodiment of the apparatus, the legs are foldable.

According to an embodiment of the apparatus, the legs are lockable using a spring loaded pin joint.

According to an embodiment of the apparatus, the legs are lockable using a snap joint.

According to an embodiment of the apparatus, the legs comprise feet of the apparatus which are configured for leveling the apparatus on a floor.

According to an embodiment of the apparatus, the apparatus further comprises a power socket, wherein the power socket is powered by a detachable extension coil.

According to an embodiment of the apparatus, the apparatus further comprises a modular bracket, wherein the modular bracket is configured to hold one or more tools.

According to an embodiment of the apparatus, the apparatus further comprises a power socket, wherein the power socket is powered by a detachable extension coil.

According to an embodiment of the apparatus, the base is covered using a base skirt, wherein the base skirt is configured to protect members from dust and hair trimmings.

According to an embodiment of the apparatus, the base skirt is detachable.

According to an embodiment, disclosed is a method, comprising unfolding legs such that the legs lie at an angle to a hydraulic spring configured for height adjustment to form a base of an apparatus, wherein a mounting bracket is attached to the hydraulic spring; unlocking the mounting bracket, wherein the mounting bracket comprises a first portion, a second portion and a flexible joint joining the first portion and second portion; sliding a seat assembly onto the second portion of the mounting bracket, wherein the seat assembly comprises a seat attached to a backrest; unfolding the backrest and adjusting an angle of the backrest relative to the seat; and wherein the method is configured for assembling an apparatus; and wherein the apparatus is configured as a chair.

According to an embodiment of the method, the seat assembly further comprises a footrest, a headrest, and an armrest attached to the seat assembly.

According to an embodiment, disclosed is a method, comprising folding a seat onto a backrest and locking the seat and the backrest to form a seat assembly; unlocking a mounting bracket connecting the seat with a base, wherein the mounting bracket comprises a first portion (first plate), a second portion (second plate), and a flexible joint joining the first portion and second portion to the base, and wherein the base comprises a hydraulic spring configured for height adjustment connected to one or more legs and the mounting bracket; moving a second portion relative to the first portion of the mounting bracket such that the second portion is in a release position; removing the seat assembly from the second portion of the mounting bracket; moving a second portion relative to the first portion of the mounting bracket such that the second portion is in a foldable position; folding the legs such that the legs lie parallel to the hydraulic spring configured for height adjustment; packing the base in a travel bag; engaging the travel bag to the modular bracket, provided on the backrest of the seat assembly to form a transportable unit; and adjusting a footrest in a handle position and positioning the transportable unit on the wheels; and wherein the method is configured for disassembling an apparatus; and wherein the apparatus is configured as a chair.

According to an embodiment of the method, the seat is connected with a footrest, the backrest comprises a modular bracket, and at least one of the seat and the backrest comprises one or more wheels where the seat and the backrest fold onto each other.

According to an embodiment of the method, in the release position the second portion is at least at a 90-degree angle with respect to the first portion.

According to an embodiment of the method, in the foldable position the second portion is parallel to the first portion.

BRIEF DESCRIPTION OF THE FIGURES

These and other aspects of the present invention will now be described in more detail, with reference to the appended drawings showing exemplary embodiments of the present invention, in which.

DETAILED DESCRIPTION

Definitions and General Techniques

Figure 1:
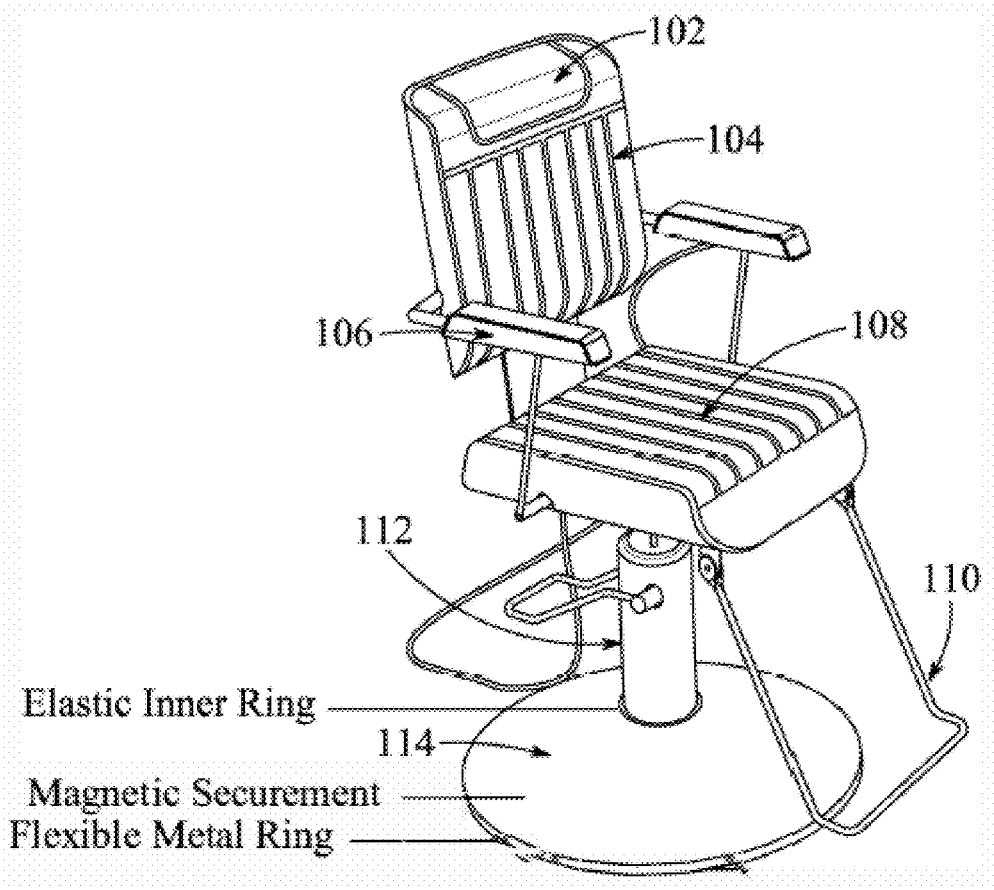
FIG. 1 shows a perspective view of a chair according to an embodiment.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

No element, act, or instruction used herein should be construed as critical or essential unless explicitly described as such. Also, as used herein, the articles "a" and "an" are intended to include items, and may be used interchangeably with "one or more." Furthermore, as used herein, the term "set" is intended to include items (e.g., related items, unrelated items, a combination of related items, and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent, or semi-permanent, or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

The present disclosure may be embodied in other specific forms without departing from its spirit or characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

Unless otherwise defined herein, scientific, and technical terms used in connection with the present disclosure shall have the meanings that are commonly understood by those of ordinary skill in the art. Further, unless otherwise required by context, singular terms shall include pluralities and plural terms shall include the singular. Generally, nomenclatures used in connection with, and techniques of, health monitoring described herein are those well-known and commonly used in the art.

The methods and techniques of the present disclosure are generally performed according to conventional methods well known in the art and as described in various general and more specific references that are cited and discussed throughout the present specification unless otherwise indicated. The nomenclatures used in connection with, and the procedures and techniques of embodiments herein, and other related fields described herein are those well-known and commonly used in the art.

The following terms and phrases, unless otherwise indicated, shall be understood to have the following meanings.

The term "portable furniture" refers to pieces of furniture designed for easy transport, movement, and storage. This type of furniture is typically lightweight, compact, and often features foldable or collapsible components, making it convenient to carry and set up in different locations.

The term "chair" as used herein also referred to as a "multi-purpose treatment chair" or "multi-functional chair" and is a versatile piece of furniture designed for seating a subject undergoing a treatment and to accommodate a wide range of uses across various industries such as beauty, healthcare, and wellness.

Herein the term "treatment" means any medical or non-medical treatment of a subject for which the subject must be or is preferably seated. The portable treatment chair of the present invention may be preferably used for personal grooming treatments, such as hairdressing/barbering, but might also be used for cosmetic treatments, such as make-up treatments and tattooing, and for medical treatments, such as dentistry.

The term "bracket" or "mounting bracket" as used herein refers to a hardware component designed to support, mount, or connect two or more parts or structures. Brackets come in various shapes, sizes, and materials, depending on their specific application and the types of elements they are intended to join. Brackets are hardware components used for joining and supporting various elements in construction and assembly. For example, angle brackets (L-brackets) are L-shaped and commonly used to connect two elements at a right angle, prevalent in furniture assembly and construction. Flat brackets, made from metal or plastic, join elements in a straight line or provide extra support to structures. U-brackets, which are U-shaped, are used to hold or support cylindrical objects like pipes and cables. Corner brackets are designed to reinforce the corners of structures, frequently utilized in shelving units and cabinets.

The term "modular bracket" as used herein refers to a versatile, adjustable component used to support, or mount different parts or structures in a customizable manner. These brackets are designed with modularity in mind, meaning they can be easily assembled, disassembled, and reconfigured to suit various applications and requirements.

The term "releasably connected" or "releasably mounted" as used herein refers to a type of connection between two or more components that allows them to be securely joined together but also easily separated when needed. This kind of connection is designed to be both strong enough to hold the components together during use and simple enough to disengage without requiring significant effort or permanent alteration to the parts involved. Releasable connections in the disclosure can be achieved through various mechanisms such as clips, snaps, latches, magnetic fittings, screws, or other fasteners designed for easy release.

As used herein, the term "gas spring", also known as a gas strut, gas lift, or gas shock, refers to a mechanical device that uses compressed gas contained within a cylinder and sealed by a sliding piston to exert a force. This force is used to support, lift, or counterbalance weights, providing smooth and controlled motion. Gas springs are commonly used in automotive applications (such as trunk and hood supports), furniture (like adjustable chairs and recliners), and various industrial and consumer products. This is also referred to as hydro-pneumatic spring, gas damper etc.

As used herein, the term "hydraulic spring" refers to a mechanical device that uses a combination of a spring mechanism and hydraulic fluid to provide controlled force and motion. This type of device integrates the properties of both a traditional spring and a hydraulic damper, offering unique advantages in applications requiring precise control over movement, damping, and force exertion. It is also referred to as hydraulic pump, hydraulic height adjustment bar, hydraulic height adjustment mechanism etc.

Mobile barber chair is a tool that supports barbers and provides an exceptional experience for their clients. As barber chairs are at the helm of luxury and practicality, intuitive, and travel friendly design is tailored to meet the needs of barbers on the go.

Figure 2:
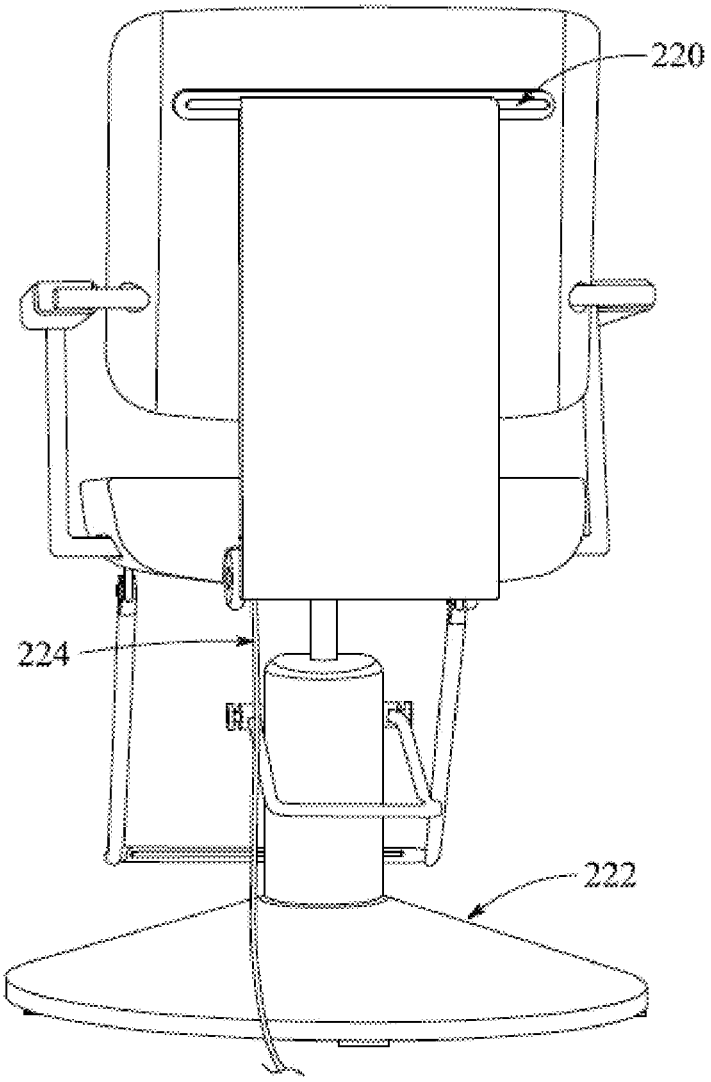
FIG. 2 shows a rear view of the chair according to an embodiment.

FIG. 1 shows a perspective view of a chair according to an embodiment. The chair comprises a headrest 102, backrest 104, armrest 106, seat 108, footrest 110, and base comprising hydraulic spring 112 configured for height adjustment, and one or more legs 114. The base comprises a cover, wherein the cover comprises an elastic inner ring, flexible metal ring, and configured for a magnetic securing of the cover. It may further be made in a color that aesthetically appeals to the user. FIG. 2 shows a rear view of the chair according to an embodiment. The chair further comprises a modular bracket 220, a pedal/lever for height adjustment 222, and a power outlet (not visible in the figures, but a wire connected to the power outlet 224 is visible. The assemblage comprises two sub-assemblies i) a seat and backrest forming a seat assembly and ii) hydraulic spring configured for height adjustment and one or more legs forming a base assembly/a stand assembly.

Figure 3A:
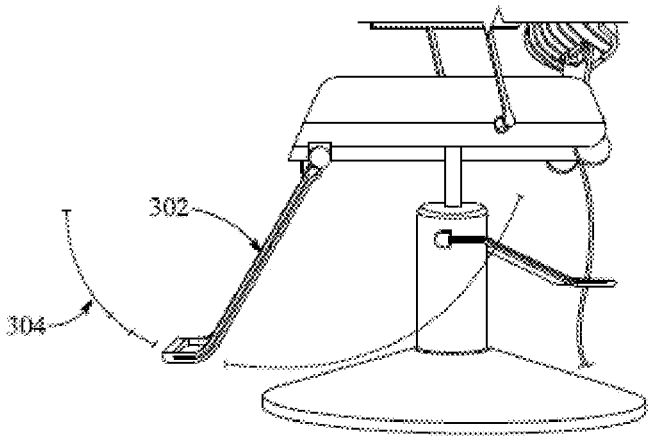
FIG. 3A shows an adjustable footrest of the chair according to an embodiment.

Adjustable footrests: FIG. 3A shows an adjustable footrest of the chair according to an embodiment. Footrest 302 is designed to be in three or more different positions i) for use by the clients to rest their feet ii) in storage position and ii) in travel position. In an embodiment, the footrest is designed to be in more than three positions. The adjustment range 304 is shown with dotted lines and adjustment positions are shown as small lines.

According to an embodiment of the apparatus, the footrest is adjustable to one or more positions using a spring-loaded pin to lock the footrest in multiple positions.

Figure 3B:
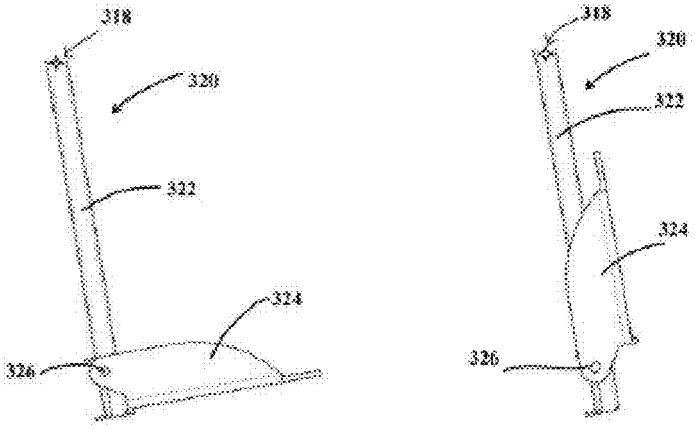
FIG. 3B shows an adjustable footrest with foot support for the chair according to an embodiment.

FIG. 3B shows an adjustable footrest with foot support for the chair according to an embodiment. In an embodiment, the footrest 320 may be releasably mounted to the footrest mounting means 318 on the underside of the seat. The footrest comprises an elongated member 322 which is mounted underneath the seat at 318 by means of any adjustable mechanism as described herein. At a distal end of the elongate member 322 there is attached a foot support 324, which is foldable between an extended position, for supporting the feet of a subject occupying the chair in use, and a folded position, in which the foot support lies up against the elongate member according to an embodiment. The foot support is attached to the distal end of the elongate member by a hinge, and preferably comprises a stop to limit the relative maximum angle between the foot support and the elongate member in the extended position, for example to prevent the foot support from unfolding beyond substantially a right-angle and may be releasably mounted so as to have an option between having the foot support or not. It may further be provided as an additional accessory along with the chair.

Figure 4:
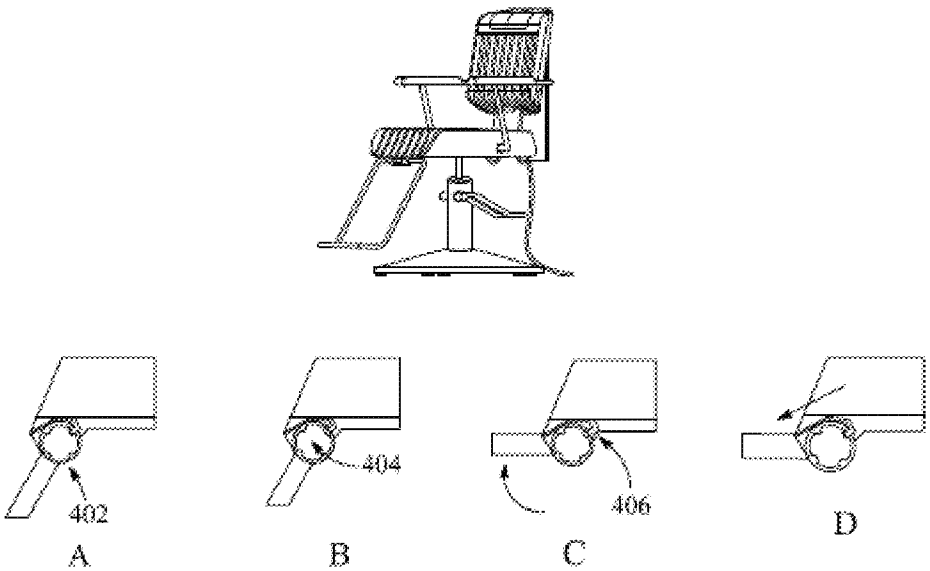
FIG. 4 shows a sample mechanism for adjusting the footrest of the chair according to an embodiment.

FIG. 4 shows a sample mechanism for adjusting the footrest of the chair according to an embodiment. Adjustable angle and height for footrest is using a spring-loaded pin mechanism 402 to lock the footrest in multiple positions. The user will depress the button 404 to release the locking pin as shown in step 1 and the leg rest will be free to rotate to the next slot 406, where the pin will automatically slide into place. The user can maneuver the footrest to the desired position as shown in step 2. The spring loaded auto-lock locks the footrest in the new position as shown at step 3.

In an embodiment, the footrest may comprise ratchet mechanism and be adjusted using ratchet mechanism. A footrest adjusting mechanism using a ratchet mechanism allows users to easily adjust and securely position a footrest at various angles and/or heights. This mechanism comprises the footrest, a support arm that connects the footrest to the chair or base, a ratchet gear with a series of teeth, a pawl that engages with the ratchet gear, and a release lever or button to disengage the pawl. A pawl is a pivoting lever that engages with the teeth of the ratchet gear to lock the position. The footrest is connected to the support arm, which contains the ratchet gear. The pawl is engaged with the teeth of the ratchet gear, holding the footrest in place. To adjust the footrest, users can lift it clockwise to raise it, with the ratchet gear allowing this upward movement as its teeth glide over the pawl, clicking into place incrementally. To lower the footrest, users press the release lever or button, which disengages the pawl from the gear, allowing free downward counterclockwise movement. Releasing the lever re-engages the pawl, securing the footrest at the desired position. This mechanism is user-friendly, providing fine control over adjustments and ensuring the footrest remains stable and locked in place once set. The footrest may further be during or after the chair height adjustment, backrest recline, etc. The chair may be used for various types of seating designed for ergonomic comfort, such as beautician chairs, barber chairs, treatment chairs, dental chairs, office chairs, and lounge chairs.

There are several alternative mechanisms for adjusting footrests in various types of seating, which are not described in full length but are apparent to a person of ordinary skill in the art. A gas spring or pneumatic mechanism uses compressed gas to provide smooth and effortless adjustment; by pressing a lever or button, the user can easily raise or lower the footrest, which is common in office chairs and adjustable recliners. Another option is the manual locking pin system, which involves pre-set holes along the support arm and a locking pin that can be inserted into any hole to secure the footrest. The screw and bolt adjustment mechanism uses a threaded rod and handwheel or knob to allow fine-tuned adjustments by turning the wheel to move the footrest up or down. The lever and cam mechanism features a rotating or sliding cam that locks into place at various points, with the user operating a lever to adjust the footrest. Motorized adjustment mechanisms use small motors controlled by a remote or built-in buttons to move the footrest to the desired position, providing effortless and precise adjustments (i.e., a dentist's chair). Friction hinge mechanisms offer adjustable resistance that holds the footrest in place without discrete locking positions, simply moving the footrest to the desired angle and relying on the hinge's friction to maintain that position. A telescoping mechanism comprises nested tubes that slide within each other, with a locking collar or clamp to adjust the footrest's length. There are many other mechanisms that can be substituted for the footrest adjustment based on the need.

Figure 5:
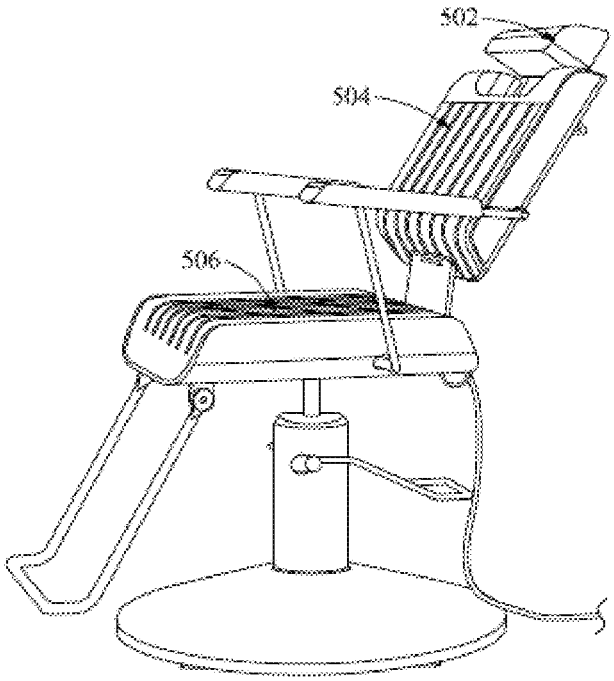
FIG. 5 shows a reclining position of a backrest of the chair according to an embodiment.

Backrest: FIG. 5 shows a reclining position of a backrest of the chair according to an embodiment. Reclining chairs are used by a lot of barbers to perform beard trims. Having the chair being able to recline backwards is a highly desirable feature. Being able to perform beard shaves or any sort of skin treatments is a nice value offering for the barbers.

Headrest 502 has multiple height adjustments to support the customer's head for a beard trim and any sort of facial treatments, while the backrest 504 is in the reclined position relative to seat 506. According to an embodiment of the apparatus, the apparatus further comprises a backrest, a headrest, and a footrest. According to an embodiment of the apparatus, the backrest is adjustable to one or more reclining positions with respect to the base using a gas spring. According to an embodiment of the apparatus, the backrest is foldable on to the seat to form a closed position. According to an embodiment of the apparatus, the backrest is foldable on to the seat and lockable in the closed position. According to an embodiment of the apparatus, the headrest is adjustable to one or more height positions using a leaf spring mechanism.

Figure 6:
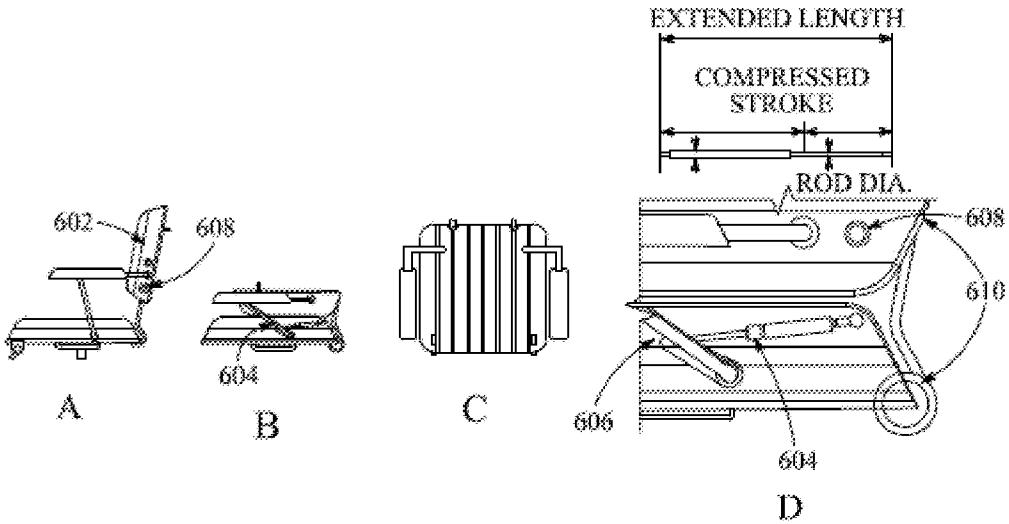
FIG. 6 shows a mechanism for adjusting the reclining position of the backrest of the chair according to an embodiment.

FIG. 6 shows a mechanism for adjusting the reclining position of the backrest of the chair according to an embodiment. Reclining movement for the backrest 602 uses a gas spring 604 attached from handles to the backrest of the chair using four bar mechanism 606. The backrest mechanism features a gas spring 604 that is hidden in the bottom/seat of the chair. Gas spring 604 is applying pressure forwards so that the chair is being pushed close, essentially. The reclining mechanism of the backrest 602 may comprise three or more reclining positions in which the mechanism can be locked. The reclining is controlled by a button 608 on the side of the chair. The location of the button 608 may be anywhere on the chair which is convenient to operate for the user. The user would press this button 608 that would allow the chair to either move forwards into the collapse position, or further back into the reclined position. The four bar mechanism 606 allows the system to keep it under tension so that there is no wobbling or rattling noises while or after adjusting the backrest 602. This also is a safety measure to make sure that when the barber is traveling with the chair in the travel position, the backrest is not going to open up accidentally as the gas spring 604 is applying pressure forwards so that the chair is being pushed close. It also enhances the sense of luxury and refinement for the user or the barber's client. As they recline, the gas spring provides controlled support, preventing a sudden backward fall, ensuring a smooth, gradual recline. This controlled movement elevates the overall user experience. In a travel position or storage position the backrest folds parallel with the seat. A travel or storage position supports the apparatus or chair to be in its compact position to either store it in a place or to carry it in the car trunk for transporting to a different location. The use position is when a barber is using the chair with the client. In an embodiment, gas spring 604 may be replaced with a hydraulic spring.

The backrest engages with the seat so as to be independently reclinable with respect to the seat. In one embodiment, the backrest may not be detachable from the seat. In another embodiment, the backrest may be detachable from the seat. The backrest is attached to the seat by one or more joints at 610 and is reclinable through a gas spring 604. Joints 610 may be replaced by any other joint which permits relative motion between the seat and the backrest.

Figure 7:
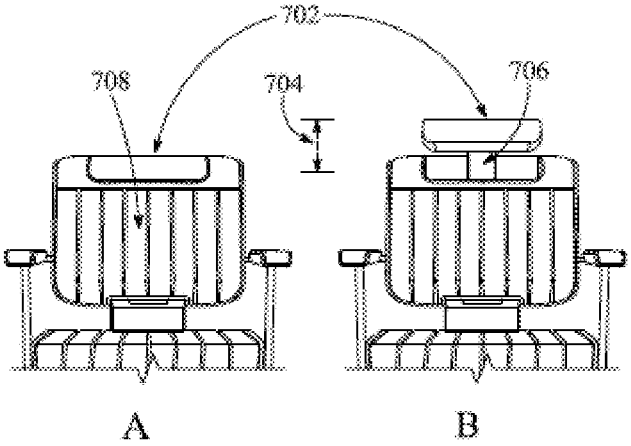
FIG. 7 shows an adjustable headrest of the chair according to an embodiment.

Headrest: FIG. 7 shows an adjustable headrest of the chair according to an embodiment. The chair allows the user to modify the height of headrest 702. It ensures that individuals of varying sizes and postures can be accommodated according to their seating preferences. This range of height adjustability 704 helps in maintaining proper alignment of the head and neck of the user. The range of height adjustability 704 may be a continuous change or may have certain specific positions within the range where the headrest may be held in place.

Figure 8:
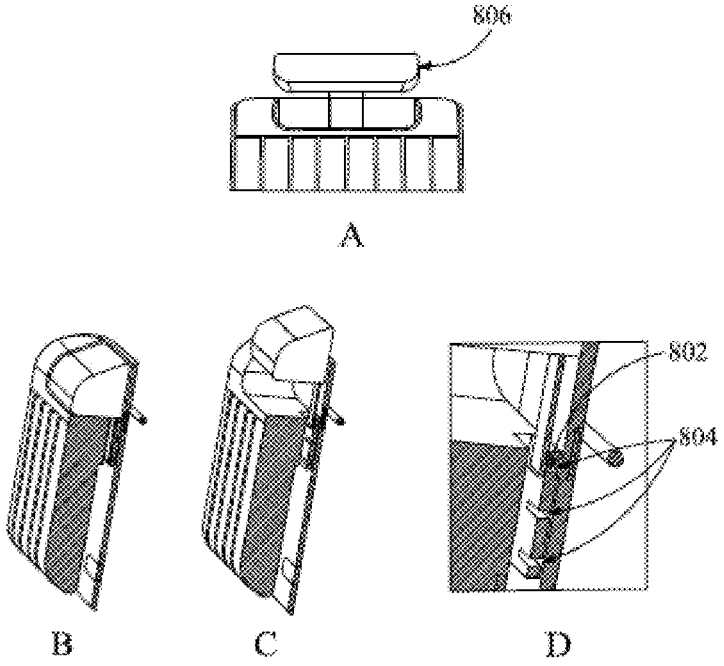
FIG. 8 shows a sample mechanism for adjusting the headrest of the chair according to an embodiment.

In an embodiment, the headrest can be removed by releasing the elongated member 706 from the backrest 708. The assemblage comprises a headrest 702 which in use is mounted on the backrest 708. The headrest 702 comprises an elongated member 706 whose one end is slid into the headrest mounting means to be held in position in the backrest 708. At the other end of the elongated member 706 there is a headrest pad for supporting the head of a subject occupying the chair in use. The distance between the headrest 702 and the backrest 708 can be adjusted by sliding the elongated member 706 into and out of the headrest mounting means and locking in position. FIG. 8 shows a sample mechanism for adjusting the headrest of the chair according to an embodiment. The headrest features a leaf spring mechanism 802 that allows it to have multiple steps or positions 804 without the user needing to push any buttons or pull the levers to minimize touch points. Number of positions 804 at which the headrest 806 may be adjusted may be designed as per the requirement.

In an embodiment, the headrest may be adjustable using a leaf spring mechanism. Other mechanisms may include the manual slide mechanism, where the headrest is moved along a track and locked into place. The headrest in another embodiment may comprise a ratchet mechanism, which allows incremental lifting and requires lifting to the highest point to release. In another embodiment, the headrest may use a button release mechanism which uses a button or lever for easy adjustments. In another embodiment, the headrest may comprise a gas spring mechanism which employs a lever for smooth, controlled movement facilitated by a gas spring. In another embodiment, it may comprise an electric adjustment mechanism, where motors control the headrest height, adjusted via a control panel. Control panel may be a remote control which is portable or a fixed control panel on the chair. In an embodiment, any or all of the mechanical elements described herein for adjustment purposes may be replaced with appropriate electronic components to facilitate automated adjustment. This automation can be achieved through the incorporation of actuators, sensors, and electronic control systems. The adjustment can be managed via a control panel, which may include a user interface, such as a touchscreen, buttons, or dials, allowing for precise control and customization. The control panel can be integrated with a microcontroller or other processing unit that receives input from the user and activates the corresponding electronic components to perform the desired adjustments. These electronic components may include, but are not limited to, electric motors, linear actuators, stepper motors, and solenoids, which can provide the necessary movement and positioning capabilities previously achieved by mechanical means. For instance, where a mechanical lever is used for adjusting the height of a chair, an electric motor coupled with a linear actuator can be employed to achieve the same function. The user can set the desired height via the control panel, which sends a signal to the motor to move the actuator accordingly. Similarly, rotational adjustments previously managed by manual knobs can be replaced with stepper motors controlled through the electronic system, providing precise and repeatable positioning. This substitution of mechanical elements with electronic counterparts not only enhances the case of use and precision but also enables integration with smart systems, allowing for remote control and automation features through wireless communication protocols such as Bluetooth® or Wi-Fi®.

The electronic components and control panel may be designed to integrate seamlessly with the existing structure, ensuring that the overall functionality and reliability of the system are maintained or enhanced. The transition from mechanical to electronic adjustment systems may be implemented in a manner that allows for backwards compatibility and minimal disruption to the existing design and operation of the device.

Figure 9:
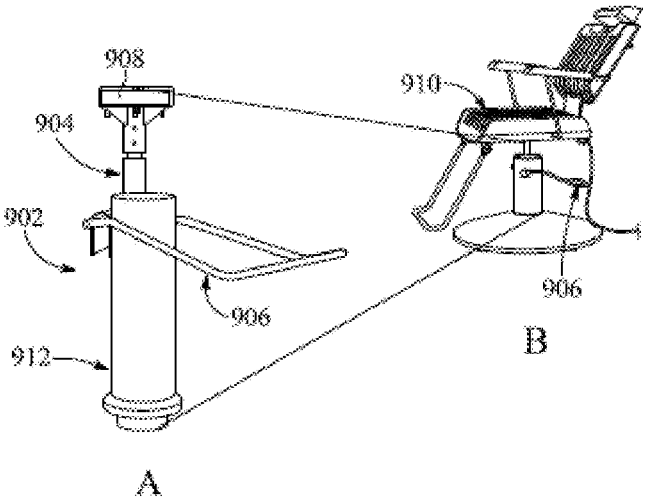
FIG. 9 shows a hydraulic bar for height adjustment of the chair according to an embodiment.

Seat height adjustment: FIG. 9 shows a hydraulic spring for height adjustment of the chair according to an embodiment. The chair uses a hydraulic spring 902 for height adjustment. This may probably be a part that could be sourced off the shelf from an existing supplier. The hydraulic spring configured for height adjustment may support a swivel plate that would provide swivel/rotatable movement of the chair. The hydraulic spring 902 comprises a piston 904. The stroke length of the piston 904 decides the maximum height adjustment of the seat. Longer stroke lengths lead to greater height adjustments and the user can choose the stroke length based on the required height adjustment. Further, a lever 906 may be used by the barber or service offeror for easy height adjustment, once the user is seated in the chair, to a comfortable height. Hydraulic spring 902 may further comprise an integrated swivel plate and a mounting bracket 908. Mounting bracket 908 engages with the receiving member underneath the seat 910.

The base assembly or stand assembly comprises seat engagement means in the form of an engagement member or mounting bracket 908 which slides and releasably locks in a corresponding receiver on the underside of the seat 910. The mounting bracket 908 and receiver are configured to intimately cooperate to substantially prevent relative movement therebetween when engaged. Thus, the receiver on the underside of the seat 910 is configured in the form of a U-groove to engage with the mounting bracket 908. The mounting bracket 908 is locked in position once engaged in the receiver.

The stand assembly or base assembly comprises hydraulic spring 902. The hydraulic spring 902 comprises an outer member 912, and an inner member which is piston 904 telescopically slidable and rotatable within the outer member. The piston 904 is moved hydraulically telescopically in and out of the outer member 912 by pumping hydraulic fluid into and out of the outer member 912, using lever 906. The mounting bracket 908 is located at the free end of the piston 904. The hydraulic spring 902 may comprise releasable locking means (not shown) for releasably locking the amount of telescopic extension of the piston 904 from the outer member 912 by preventing ingress and egress of hydraulic fluid, whilst leaving the piston 904 free to rotate within the outer member 912. The system can be designed for various maximum and minimum height adjustments.

Figure 10:
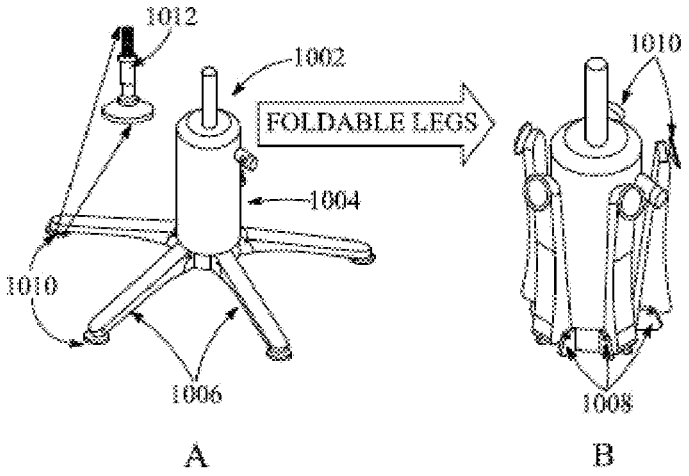
FIG. 10 shows the base of the chair with foldable legs according to an embodiment.

Hub with legs: FIG. 10 shows the base of the chair with foldable legs according to an embodiment. The base 1002 comprises hub 1004 along with folding legs 1006. The hub 1004 is formed from the hydraulic spring 902 (shown in FIG. 9). The base provides the foundation for the rest of the chair. The legs are made mechanically sound such that they can withstand the weight of the chair and user and also can stand stable without any wobble. Further, they are designed to be very compact, so that the user can easily assemble, disassemble, and take it to and from their client site. Featuring hinge joints 1008 allows the hub to be in compact form while minimizing the number of steps that the user would take to disassemble as they are simply required to be folded up. The legs will be locked with a spring loaded pin, or any other locking mechanism such as a latch. Spring loaded mechanisms for locking may also produce a simple click sound when the pins fall in place and lock the legs providing an auditory feedback to the user that the legs are locked. They allow the user to fold the legs down into the open position, the legs would lock in place with the help of pins. The legs may comprise feet 1010 which are leveling feet 1012 which are adjustable in height. This feature helps to level the chair in case the chair is situated on an unlevel floor. The legs feature rubber feet that are also height adjustable for stability on uneven surfaces and further act like shock absorbers when the user sits on the chair or when the chair is being adjusted. When the user is finished using the chair, they would unlock the legs and they would pull them back up and place them into the bag.

The stand assembly or base assembly also comprises legs 1006 for supporting the chair in use (for case of reference, only a few legs 1006 are identified, as appropriate, in the figures). The legs 1006 are foldable from an extended position in which they extend laterally from the stand assembly to support the chair in use, and a folded position in which they lie against the outer member of the hydraulic spring. The legs 1006 are pivotally attached to the lower (closed) end of the outer member at their proximal ends and are lockable in the extended and folded positions by locking pins. The legs comprise feet of the chair at their distal ends to support the chair in use, the feet screw into the distal ends of the legs. This allows for depth adjustment of the feet relative to the legs for leveling the height of the chair. The number of legs 1006 is not critical but must be sufficient to provide the chair with sufficient stability in use. In an embodiment the base assembly comprises one or more legs which are foldable. In an embodiment, the hydraulic spring configured for height adjustment may be detachable from the base. In an embodiment, a hydraulic spring may be replaced with any other appropriate mechanism for height adjustment, for example a gas spring.

According to an embodiment of the apparatus, the base comprises a hydraulic spring configured for height adjustment forming a hub and one or more legs. According to an embodiment, the apparatus's legs are foldable.

According to an embodiment of the apparatus, the legs are lockable using a spring loaded pin joint. According to an embodiment of the apparatus, the legs are lockable using a snap joint. According to an embodiment of the apparatus, the legs comprise feet of the apparatus which are configured for leveling the apparatus on a floor.

According to an embodiment of the apparatus, the base comprises a hydraulic spring configured for height adjustment forming a hub and one or more legs. According to an embodiment of the apparatus, the legs are foldable. According to an embodiment of the apparatus, the legs are lockable using a spring loaded pin joint. According to an embodiment of the apparatus, the legs are lockable using a snap joint. According to an embodiment of the apparatus, the legs comprise feet of the apparatus which are configured for leveling the apparatus on a floor.

Assembly: For the barbers who are traveling to and from their client site, a chair that is easy to assemble in as few steps as possible is designed. The assemblage comprises i) seat and backrest assembly and ii) base assembly (or stand assembly).

Figure 11:
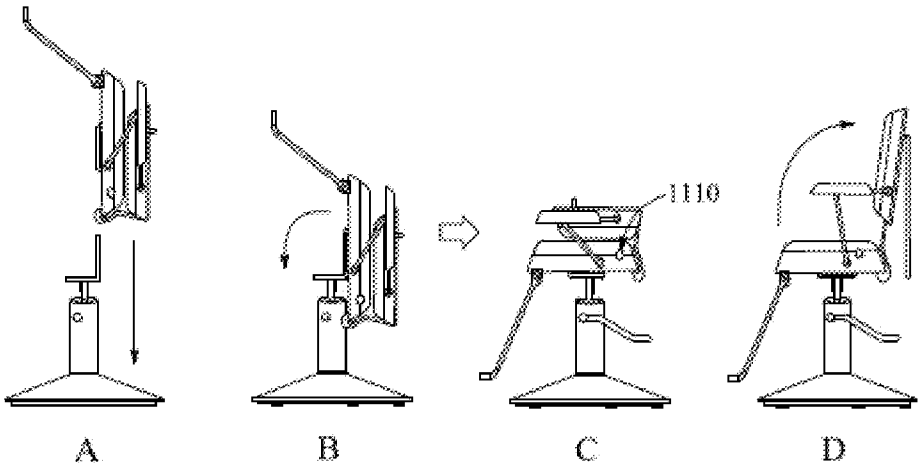
FIG. 11 shows assembling the chair according to an embodiment.

FIG. 11 shows assembling the chair according to an embodiment. For assembling, hinges of the legs are opened, and the base is set up, the user would place the chair on top of the hydraulic piston on the mounting bracket and then bring down the leg rest and bring up the backrest and the chairs ready for their clients. For assembly, slide the seat of the chair down vertically onto the mounting bracket of the base such that the seat engages with the base at step 1. Fold the seat assembly forwards to make the seat assembly perpendicular to the base and lock the mounting bracket place at step 2. Locking of the mounting bracket may be automatic in an embodiment. The user may release the and pull up the backrest from the seat with the help of a button 1110 on the side to adjust to any of the locking positions for the backrest as shown at step 3.

The seat and backrest may each comprise a frame onto which a padded base board is respectively attached.

According to an embodiment, disclosed is a method, comprising unfolding legs such that the legs lie at an angle to a hydraulic spring configured for height adjustment to form a base of an apparatus, wherein a mounting bracket is attached to the hydraulic spring configured for height adjustment; unlocking the mounting bracket, wherein the mounting bracket comprises a first portion, a second portion and a flexible joint joining the first portion and second portion; sliding a seat assembly onto the second portion of the mounting bracket, wherein the seat assembly comprises a seat attached to a backrest; unfolding the backrest and adjusting an angle of the backrest relative to the seat; and wherein the method is configured for assembling a apparatus; and wherein the apparatus is configured as a chair. According to an embodiment of the method, the seat assembly further comprises a footrest, a headrest, and an armrest attached to the seat assembly.

Disassembly: For disassembly, the same sequence of events may be performed in reverse, e.g., folding the backrest onto the seat, unlocking, and unfolding the mounting bracket to position the seat assembly in the upright or vertical position, disengaging the seat assembly from the mounting bracket, folding the feet and legs into the folded position as appropriate. The disassembled base assembly may then be packed into a travel bag, attached to the modular bracket on the backrest. The footrest is then adjusted to act as a handle (/in handle position) and the portable furniture is made into a travel position and transported to a different location for reassembly.

According to an embodiment, disclosed is a method, comprising folding a seat onto a backrest and locking the seat and the backrest to form a seat assembly; unlocking a mounting bracket connecting the seat with a base, wherein the mounting bracket comprises a first portion, a second portion, and a flexible joint joining the first portion and second portion and the base, and wherein the base comprises a hydraulic spring configured for height adjustment connected to one or more legs and the mounting bracket; moving a second portion relative to the first portion of the mounting bracket such that the second portion is in a release position; removing the seat assembly from the second portion of the mounting bracket; moving a second portion relative to the first portion of the mounting bracket such that the second portion is in a foldable position; folding the legs such that the legs lie parallel to the hydraulic spring configured for height adjustment; packing the base in a travel bag; engaging the travel bag to the modular bracket provided on the backrest of the seat assembly to form a transportable unit; and adjusting a footrest in a handle position and positioning the transportable unit on the wheels; and wherein the method is configured for disassembling an apparatus; and wherein the apparatus is configured as a chair.

According to an embodiment of the method, the seat is connected with a footrest, the backrest comprises a modular bracket, and at least one of the seat and the backrest comprises one or more wheels where the seat and the backrest fold onto each other. According to an embodiment of the method, in the release position the second portion is at least at a 90-degree angle with respect to the first portion. According to an embodiment of the method, in the foldable position the second portion is parallel to the first portion.

Figure 12:
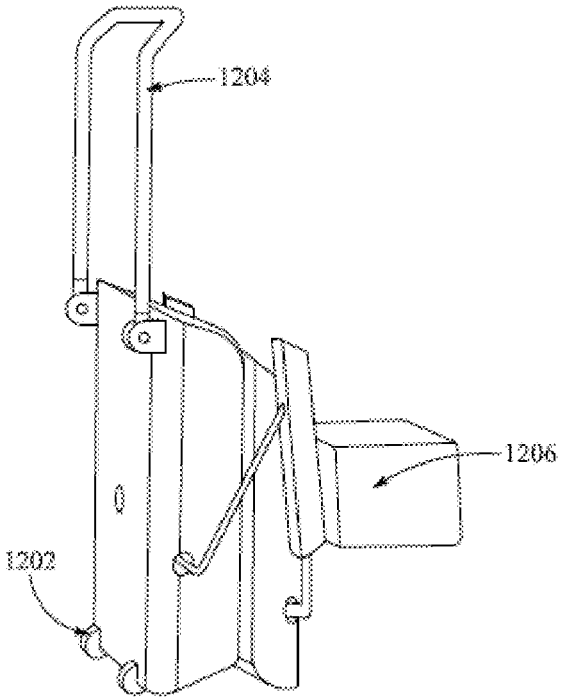
FIG. 12 shows the chair in transport mode according to an embodiment.

Transport mode/travel position: FIG. 12 shows the chair in transport mode according to an embodiment. In transport mode or travel position, the base which has built in wheels 1202 are placed on the floor such that the wheels can roll on the floor. The footrest 1204 is locked in a position to act like a handle as shown. In the travel position the chair appears similar to that of a suitcase or like a travel bag to tilt and roll. The base with the hydraulic bar features foldable legs that can swivel on a hinge and lock into place with a locking mechanism. These legs can be folded to conveniently fit inside a travel bag 1206. The travel bag 1206 would then be hung or attached to a modular bracket (not visible in the figure). In a travel position, the chair is similar to that of a carry-on suitcase.

Wheels on the seat base: FIG. 12 shows wheels 1202 that are attached to one side of the seat and the footrest 1204 attached on the opposite side that can be configurable to be used as a handle. The whole unit can be pulled as a briefcase or suitcase. There is also a small rubber foot on the backrest, like a foot on a suitcase, that helps to stabilize the portable unit and to protect the chair backrest while the unit is being transported. In an embodiment, both seat and backrest comprise wheels similar to that of trolley suitcase or trolley bag to roll on the floor just by pushing or pulling without needing to tilt to avoid any weight onto the handle while pulling to dragging.

Figure 13:
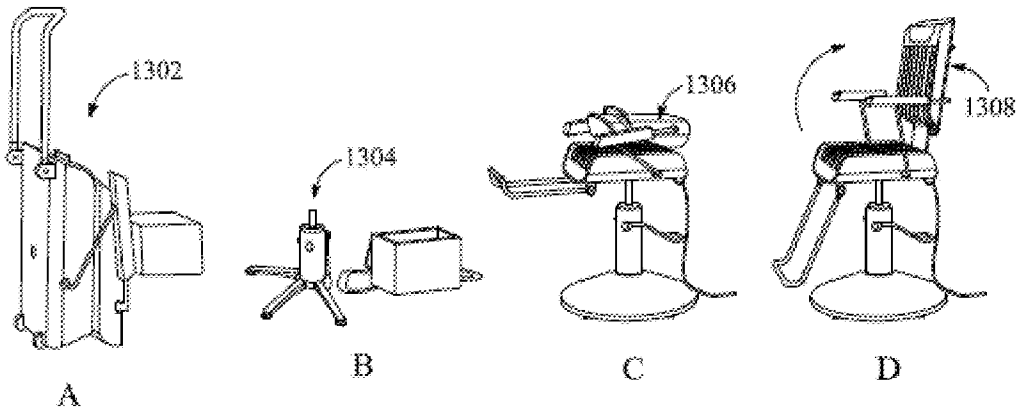
FIG. 13 shows steps for assembling the chair according to an embodiment.

FIG. 13 shows steps for assembling the chair according to an embodiment. In the first step, the chair is in travel position 1302 as described in FIG. 12. In the second step, the user will open the travel bag, remove the base from the travel bag, and unfold the pivoted legs into an open position such that they get locked in the position as shown in 1304. In the third step, the seat is assembled to the base comprising the mounting bracket (L-bracket) attached to the hydraulic spring. It is assembled in a vertical position with one part of the mounting bracket open and then is folded down to the position shown in 1306 securing the seat assembly with the base. In the fourth step the backrest is unlocked, unfolded, and is reclined to a desired reclining position as shown in 1308. Further, the footrest and headrest can be adjusted as desired.

Figure 14:
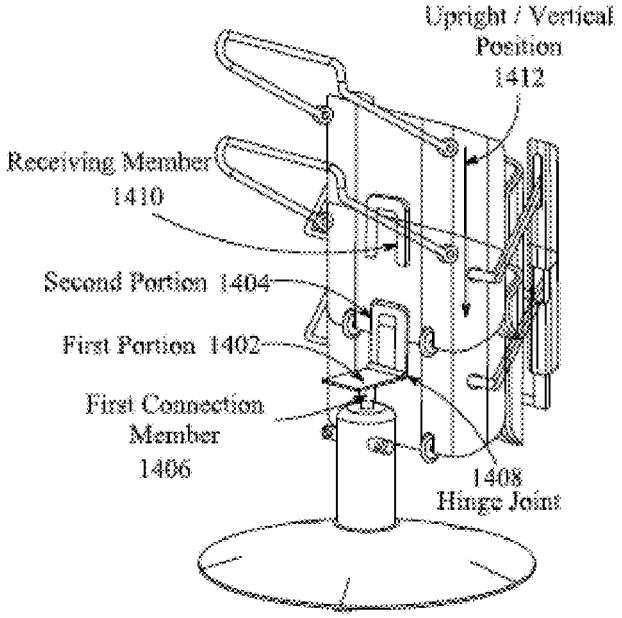
FIG. 14 shows a closeup view of the mounting bracket used in assembling and disassembling the chair according to an embodiment.

Mounting Bracket: FIG. 14 shows a closeup view of the mounting bracket used in assembling and disassembling the chair according to an embodiment. For assembling the seat to the hydraulic base, a mounting bracket (L-bracket) is used. First portion 1402 is attached on top of the hydraulic cylinder/hydraulic spring configured for height adjustment using a first connection member 1406. The first connection member could be a joint comprising one of a bolt and nut joint, a snap fit joint, a welding joint, an interference fit joint, etc. A second portion 1404 of the mounting bracket is configured to be opened and closed/locked with the first portion 1402. The second portion 1404 is configured to be releasably mounted/coupled to the seat (seating base) of the chair. The first portion 1402 and the second portion 1404 are connected using a hinge joint 1408 allowing second portion 1404 of the mounting bracket to open and close as needed. When the mounting bracket is in an open position, users can slide the second portion 1404 of the mounting bracket onto the receiving member 1410 which is a mating mounting bracket holder on the underside of the seat. The receiving member 1410 may be fixed to the underside of the member using a second connection member. The second connection member could be a joint comprising one of a bolt and nut joint, a snap fit joint, a welding joint, an interference fit joint, etc. For connecting two members any of the connection members, i.e., joints can be used. Joints are selected based on member geometry and vary significantly depending on the shapes and structural requirements of the components involved, such as tube form, plate form, and other forms. Tube forms can be joined using welded joints, where tubes are fused together for a strong, permanent connection; slip joints, where one tube fits into another and is secured with clamps or screws for easy disassembly; and threaded joints, where tubes with matching threads are screwed together. Other joints can be flange joint, clamp joint, bolted joints, grove based joints, sliding joints. The joining of the mounting bracket portion to the receiving member can be using tongue and groove joint, snap fit joint, etc. such that one member slides into a slot provided on the other member and locks automatically or the motion is limited due to a mechanical stop that is designed.

Figure 16:
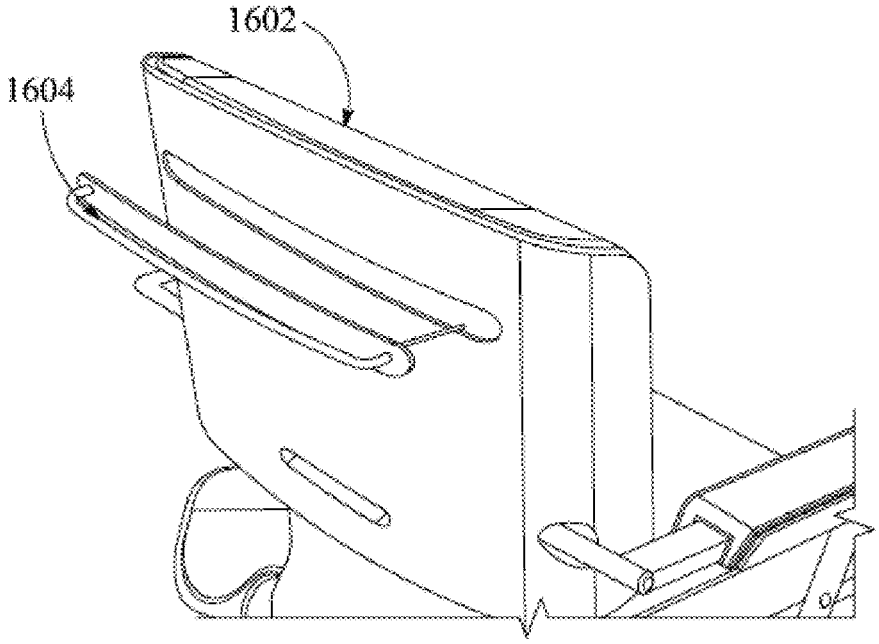
FIG. 16 shows a modular bracket of the chair according to an embodiment.

In general, trying to pick up a chair, or any component which is heavy and unwieldy in shape, by its base (seating base) in a folded position and lifting it over to the hydraulic bar can be straining on the user's back. So, this mechanism is designed to make sure that the chair is kept in an upright position/vertical position as depicted by a downward pointing arrow shown as 1412, like that of a suitcase held with a handle. The base may be provided with a handle of suitable shape and size to lift the base assembly and assemble using receiving member 1410 which is a mounting bracket holder. In an embodiment, the modular bracket may act as a handle (modular bracket is shown in FIG. 16); this sort of assembly is more ergonomic for the user. The design is set up to assemble and disassemble in an upright position 1412 proves more helpful when there is a repeated assembly and disassembly needed. The mounting bracket can be in two positions i) release position where the second portion 1404 makes a 90 degree angle with the first portion 1402 (or perpendicular to the first portion) and ii) lock position/foldable position where the second portion 1404 is parallel to the first portion 1402. In release position the mounting bracket may be designed to make any other angle other than 90 degrees. In the embodiment shown, the first portion 1402 and second portion 1404 are at a 90 degree angle. Further, the mounting bracket may be fixedly connected to the base at the hydraulic spring configured for height adjustment using first connection member 1406 and releasably connected to the base of the chair at receiving member 1410.

According to an embodiment, disclosed is an apparatus comprising, a seat, a base for supporting the seat; and a mounting bracket connecting the seat and the base; wherein the mounting bracket comprises a first portion, a second portion and a flexible joint joining the first portion and second portion; the first portion connected to the base via a first connection member; the second portion is received by a seat comprising a receiving member, wherein the receiving member is connected to the seat using a second connection member; wherein the second portion moves between a foldable position and a release position relative to the first portion; wherein the mounting bracket is configured to be locked in foldable position securing the seat to the base; and wherein the mounting bracket is configured to be in release position for assembly and disassembly of the seat from the base; and wherein the seat is configured to be assembled to the base in an upright position by a user. According to an embodiment of the apparatus, the apparatus is a seating apparatus. According to an embodiment of the apparatus, the apparatus is one of a chair, a stool, a table, a component of a machine, a component of a portable furniture, a component of an exercise machine etc. A component of a machine, portable furniture, exercise machine etc. could be formed from assembling the one part with another in the upright position using a mounting bracket which can be in release position and lock position. According to an embodiment of the apparatus, the first portion is configured to be a first plate. According to an embodiment of the apparatus, the second portion is configured to be a second plate. According to an embodiment of the apparatus, the receiving member is in a U-groove to receive the second plate. According to an embodiment of the apparatus, the flexible joint joining the first portion and second portion comprises a hinge joint. According to an embodiment of the apparatus, the first portion and second are lockable using a mechanical locking mechanism. According to an embodiment of the apparatus, the first portion and second are lockable using a magnetic locking mechanism. According to an embodiment of the apparatus, the seat is configured to swivel with respect to the base.

According to an embodiment, disclosed is an apparatus comprising a seat, a backrest, a base, a footrest, and one or more wheels; the seat comprising a first side configured for a user to sit, and a second side comprising a receiving member for receiving a second portion of a mounting bracket, wherein the mounting bracket comprises a first portion connected to the base and the second portion that moves between a foldable position and a release position relative to the first portion; the backrest engaging with the seat such that the backrest is independently reclinable with respect to the seat and being foldable onto the first side of the seat to form a folded position and lockable in the folded position; the footrest connected to the seat at a first position configured to receive feet of the user when seated; the wheels connected to at least one of the seat and the backrest at a second position, wherein the second position is at opposite side of the first position such that the footrest is configured to be used as a handle while the wheels are configured to support the weight of the apparatus and facilitate transportability of the system. According to an embodiment of the apparatus, the apparatus is a chair.

According to an embodiment of the apparatus, the backrest is reclinable in one or more positions with respect to a base using a gas spring. According to an embodiment of the apparatus, the headrest is adjustable in one or more positions using a leaf spring mechanism. According to an embodiment of the apparatus, the footrest is adjustable in height and angle using a spring-loaded pin to lock the footrest in multiple positions. According to an embodiment of the apparatus, the seat is configured to swivel with respect to the base.

Figure 15:
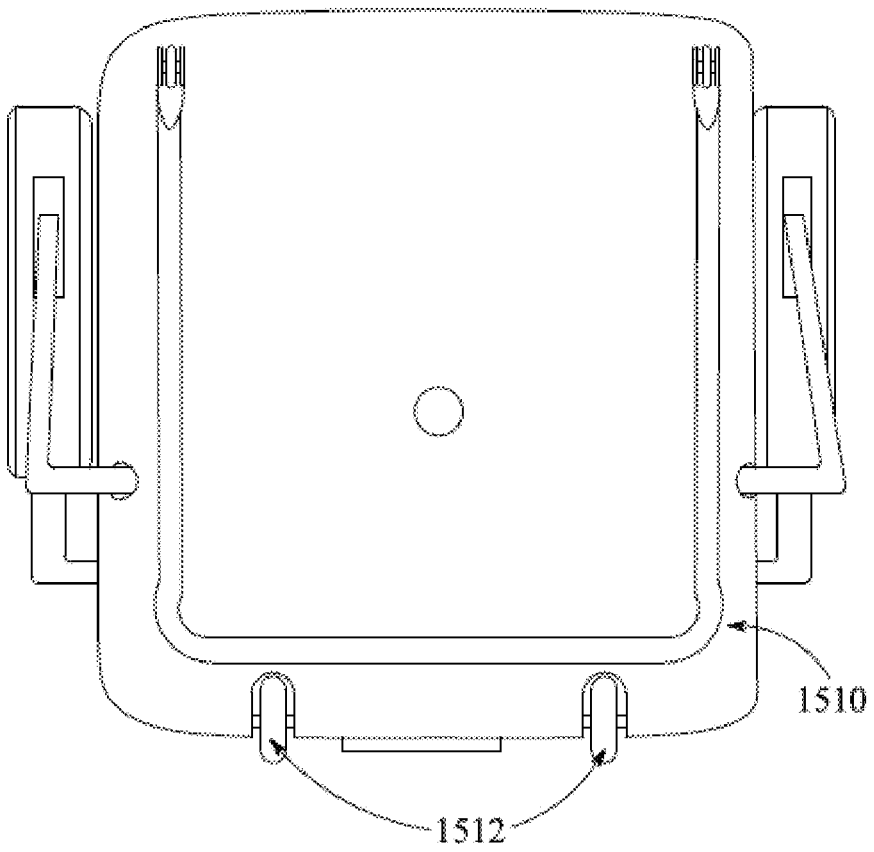
FIG. 15 shows the chair in storage position according to an embodiment.

Storage Position: FIG. 15 shows the chair in storage position according to an embodiment. When traveling by vehicle, users can fold down the chair to fit it in their back seat or trunk. When not in use, the chair can be stored compactly in a closet. This position also highlights the position of the leg rest 1510 which is in the compact folded position along the seat. FIG. 15 also shows the wheels 1512 which are integrally attached to the seat of the chair. In an embodiment, there may be one or more wheels attached to the seat of the chair. In an embodiment, the wheels may be attached or detached as needed. In another embodiment, the chair may be placed on wheels that are separate from the chair assembly. In an embodiment, the base and the backrest may both have wheels similar to that of a trolley suitcase. In an embodiment, the base may have the wheels and the backrest may have feet to balance the height of the wheels similar to that of a two-wheeled suitcase. According to an embodiment of the apparatus, the seat comprises one or more wheels.

Modular Bracket: FIG. 16 shows a modular bracket of the chair according to an embodiment. The chair may be used by chiropractors or other service offerors who need a chair to hold various accessories. Backrest 1602 may comprise a modular bracket 1604 such that it is able to hold various tools or a toolbox with accessories that the practice needs. Modular bracket 1604 can be used to hook a container with more targeted accessories for service offerors. The bracket may act as a handle as well for lifting or lowering the chair during assembly and disassembly. Modular bracket 1604 has multiple uses, one of which is carrying the travel bag. The other uses are carrying a barber cape that is used to drape over the clients' shoulders to prevent them from getting hair on them during a haircut. In an embodiment, the modular bracket is configured to be removed from the backrest of the chair and replaced with another bracket, whether it is a purpose built bracket or a shelf. The chair may be used by a hairstylist who uses the bracket for hair dyeing or haircutting accessories. A modular bracket can potentially be configured for holding different accessories that serve the service offerors using the chair, such as stylists or physicians, etc. According to an embodiment of the apparatus further comprises a modular bracket, wherein the modular bracket is configured to hold one or more tools.

Figure 17:
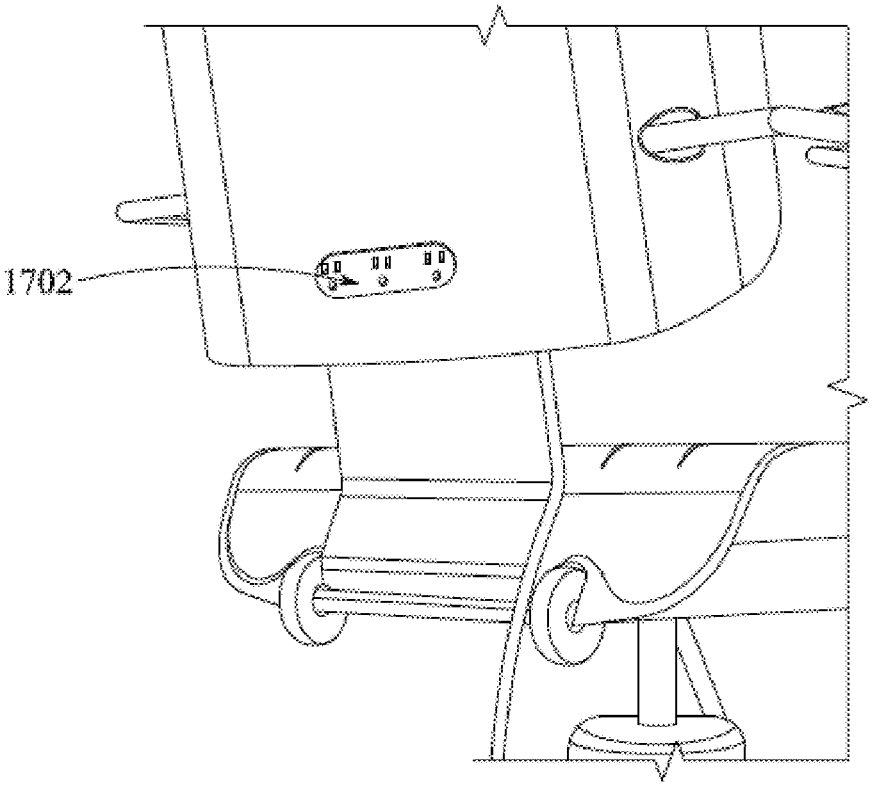
FIG. 17 shows a power outlet integrated into the chair according to an embodiment.

FIG. 17 shows a power outlet integrated into the chair according to an embodiment. In an embodiment, power supply sockets 1702 may be integrated to the chair. In another embodiment, power supply sockets may be built-in or attached. The power socket is powered by a power cable or a detachable extension cable. The cable will release easily when pulled or slightly yanked intentionally or unintentionally, in the case of someone tripping on the cord. The detaching feature may be based on magnetic coupling and decoupling. A detaching cable is also compact for travel and storage. According to one embodiment, a power strip is embedded into the back of the chair. When a barber arrives at the client's house, there is not always power and good lighting available at the location where the barber may need it. Therefore, the power socket feature allows the service offeror, like a barber, to bring the power to where they need it most. The power socket feature on the back of the chair allows the barber to plug in their hairdryer, clippers, or even the client/user to plug in and charge their phone if necessary.

According to an embodiment of the apparatus, the apparatus further comprises a power socket, wherein the power socket is powered by a detachable extension coil. According to an embodiment of the apparatus, the apparatus further comprises a power socket, wherein the power socket is powered by a detachable extension coil.

Figure 18:
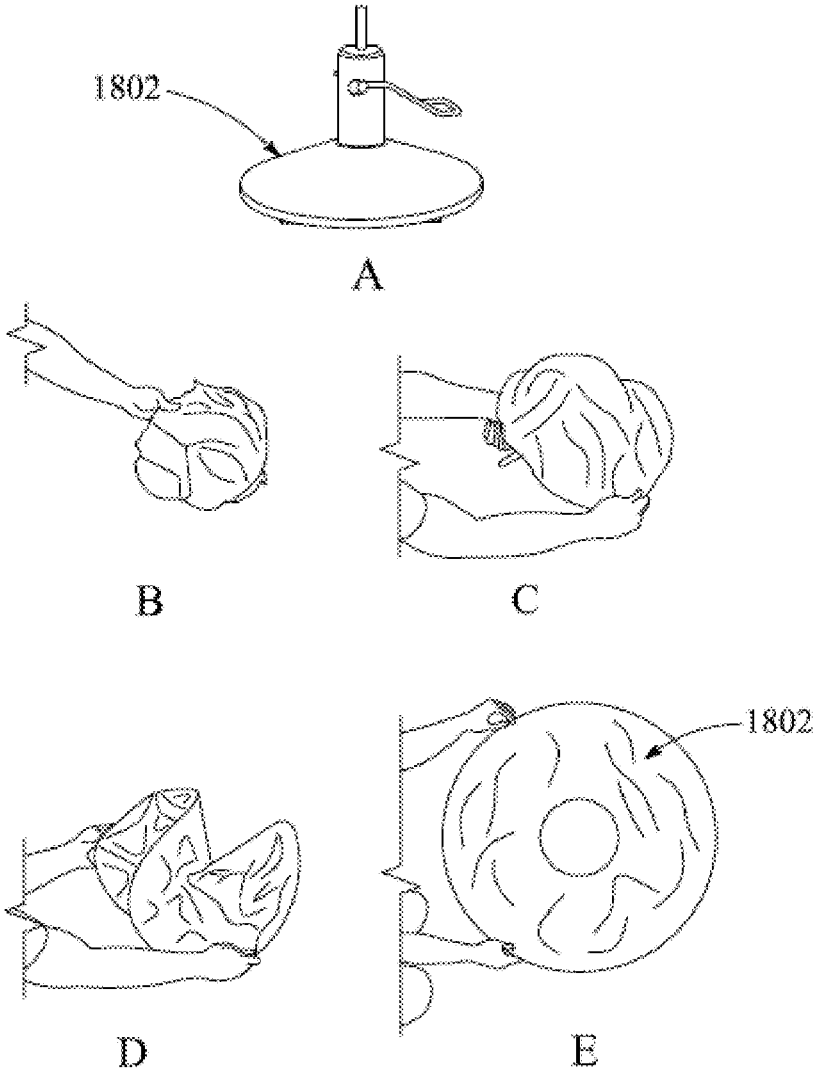
FIG. 18 shows a foldable cover for the base of the chair according to an embodiment.
Figure 19:
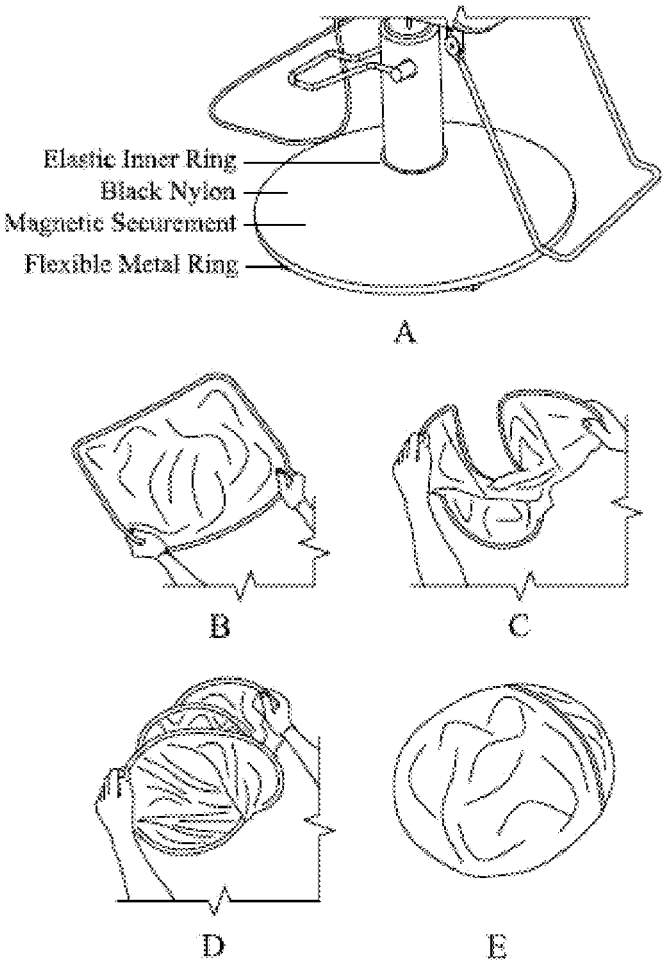
FIG. 19 shows a foldable cover for the base of the chair according to an embodiment.

Base Skirt: FIG. 18 shows a foldable cover for the base of the chair according to an embodiment. FIG. 19 shows a foldable cover for the base of the chair according to an embodiment.

A base skirt 1802 is used to cover the base for easy cleaning. The base skirt is collapsable for easy storage and will use magnets or fasteners to secure it to the base. A detachable base skirt around the base of the chair allows for easy cleaning. The base skirt is also designed to be aesthetically pleasing. The base skirt protects the base from getting fine hairs or dust collecting and clogging the base. The base skirt lets the hair not get in and makes it slide outside of the base and on to the floor for easy cleaning. According to an embodiment of the apparatus, the base is covered using a base skirt, wherein the base skirt is configured to protect the base from dust and hair trimmings. According to an embodiment of the apparatus, the base skirt is detachable. According to an embodiment of the apparatus, the base is covered using a base skirt, wherein the base skirt is configured to protect the base from dust and hair trimmings. According to an embodiment of the apparatus, the base skirt is detachable.

A foldable synthetic material with a flexible ring around the base, like a windshield sunshade, can be used. This design includes a flexible ring around a central hole, allowing it to fit over the top of the hydraulic mechanism and cover the legs. This setup helps barbers clean up hair and dust efficiently and enhances the chair's overall look, giving it a luxurious feel akin to a professional salon or barbershop.

The chair may be useful for barbers, beauticians and the like who intend to carry out their services/operations at a client's place, however it is equally suitable as a stationary chair. A chair, when used stationarily, without any position or place change, would not need to collapse, no need for wheels, no leg rest, no need to be able to detach from the hydraulic lifter in such an easy and simple way. However, the chair with mounting bracket for assembly can be used for any chair, either stationary or moveable. The mounting bracket can be used in many furniture assemblies, for example, stools, tables, etc.

From a size perspective, an additional booster seat will enable it to be used by a child, and the regular height, backrest, footrest adjustments enable it to be used by a big and tall person. The chair is designed for the 90th percentile, of the different sizes of the human anatomy. It can cover a wide range of sizes of the people. For the kids/children, a booster chair may be needed. Such accessories can be secured to the seat base and backrest. For someone tall, the height adjustment, and the footrest adjustment should be accommodating to their extra legroom requirements. An accessory booster chair that is able to either inflate or collapse may be included in the travel bag.

The following chair features for transportation and assembly:

Collapsing backrest onto the seat via a button release.

Base with Hub with legs that are foldable using pivot joints and lockable while transporting the chair comprising a hydraulic spring configured for height adjustment attached with a folding and lockable mounting bracket for easy assembly and disassembly of the chair in vertical position/upright position.

Modular bracket in the chair to hold the box comprising the base and hydraulic bar of the chair while the chair is being transported.

Integrated/attachable wheels at the seating base of the chair for transportation.

Footrest changeable in height and lockable in position, and to act as a handle for portability of the chair when closed.

Portable chair/furniture assembly: An assemblage is disclosed for assembling into a treatment chair for seating a subject undergoing a personal treatment, and subsequently disassembling for reassembly at another location. The assemblage comprises a seat and backrest assembly, and a stand assembly for rotatably supporting the seat and backrest assembly. The seat and backrest assembly comprise a seat and a backrest, the seat comprising an upper side on which the subject sits in use, and an underside comprising a stand assembly mounting means for releasably mounting the stand to the base assembly. The seat further comprises a first side comprising a leg rest and a second side comprising one or more wheels. The backrest engages with the seat so as to be independently reclinable with respect to the seat and foldable onto the upper side of the seat so as to lie substantially flat therewith. The stand assembly comprises seat engagement means for releasably engaging with the underside of the seat, hydraulic spring configured for height adjustment for hydraulically raising and lowering the height of the seat and backrest assembly in use, and one or more legs which are foldable between an extended position in which the legs extend laterally from the stand assembly to support the treatment chair in use, and a folded position in which they lie against or adjacent to the hydraulic spring configured for height adjustment.

The present invention provides an assemblage for assembling a treatment chair for seating a subject undergoing a personal treatment, such as a haircut. The assemblage can be compactly packed, preferably in a case or bag, transported to a treatment location in a passenger vehicle, preferably in the trunk of a saloon car or hatchback (for example a Compact car or larger according to Association of Car Rental Industry Systems Standards (ACRISS) car classification code) without needing to fold down the rear seats, and to quickly and easily be assembled into the treatment chair in situ. Preferably, the assemblage weighs 25 kg or less so as to be portable by an individual. Preferably the assemblage can be assembled and disassembled tool-free, for example through quick-release locks and self-locking mechanisms. However, when assembled the treatment chair has the functionality of a conventional treatment chair as found, for example, in a hairdressing salon or barbershop, i.e., the seat and backrest assembly swivels, is height adjustable, and the backrest is reclinable relative to the seat, all with a child or adult human subject occupying the treatment chair, preferably a subject weighing up to 120 kg (this being a typical maximum loading for treatment chairs). In contrast, in an office location for example, a typical office swivel chair is only height adjustable when it is not occupied, which makes it unsuitable for use as a treatment chair.

The assemblage of the present invention is portable by an individual, and the materials from which it is made should preferably be selected to reduce weight where possible. Suitable materials may include mild steel tubing (e.g. for frames), stainless steel (e.g. for locking components), aluminum (i.e., for frame and lock mountings), chrome-plated metal, polypropylene and/or plywood (i.e., for seat or backrest base boards), nylon (i.e., for locking components), seat foam and nylon cover material (i.e., for padded components).

The assemblage of the present invention preferably further comprises carrying and/or storage means, for containing the disassembled assemblage for transportation from one location to another, and/or storage when not in use. For example, the carrying and/or storage means may comprise one or more of travel bags, covers, or foam-containing cases, wherein the foam comprises recesses into which the different component parts of the assemblage may be placed. The recesses may be tailored to the specific shapes of the component parts by, for example, Computer Numerical Control (CNC) routing.

Assembly of the assemblage into the treatment chair may be performed as per convenience for the user and need not be assembled in any particular order. However, a possible sequence of actions is as follows. For assembly: the legs are unfolded from the folded position to the extended position and preferably locked in position, may be automatically, and where appropriate the feet are similarly attached to the legs or unfolded from the legs, so that the legs can be positioned securely on the floor. If appropriate, the position of the feet relative to the legs may be adjusted, for example by screwing the feet in/out of the legs, to level the height of the chair. The mounting bracket is engaged with the receiving member (a groove) on the underside of the seat in upright position/vertical position. For example, in preferred embodiments the receiving member on the underside of the seat may be placed on the mounting bracket, slid, and folded into locked position, which is horizontal position. The seat with the attached backrest forming a seat assembly can be unfolded from its folded position. Armrests, headrest and/or a footrest that are already part of the seat assembly may further be adjusted to desired height and angle.

In use, once assembled a subject can occupy the treatment chair, and the user can make whatever adjustments to the position of the chair as desired, for example raising the height of the seat and backrest assembly, raising, or lowering the headrest, and reclining the backrest, whilst the subject occupies the treatment chair. The seat and backrest assembly swivels on the stand assembly.

The descriptions of the one or more embodiments are for purposes of illustration but are not exhaustive or limiting to the embodiments described herein. Many modifications and variations will be apparent to those of ordinary skill in the art without departing from the scope and spirit of the described embodiments. The terminology used herein best explains the principles of the embodiments, the practical application and/or technical improvement over technologies found in the marketplace, and/or to enable others of ordinary skill in the art to understand the embodiments described herein.

INCORPORATION BY REFERENCE

All references, including granted patents and patent application publications, referred herein are incorporated herein by reference in their entirety.

US Patent Application Publication US20230346123A1, titled, "Assemblage for forming a treatment chair"

U.S. Pat. No. 3,235,305A, titled, "Barber chair with sterilizer"

U.S. Pat. No. 5,489,140A, titled, "Portable beautician's chair"

WO Patent Application Publication WO2002056734A1, titled, "Shampoo chair"

U.S. Pat. No. 6,655,732B1, titled, "Multiple position leg rest mechanism for a reclining chair"

The invention claimed is:

1. An apparatus comprising, a seat, a base for supporting the seat; and a mounting bracket connecting the seat and the base;

wherein the mounting bracket comprises a first portion, a second portion and a flexible joint joining the first portion and second portion;

the first portion connected to the base via a first connection member; and the second portion is received by the seat comprising a receiving member, wherein the receiving member is connected to the seat using a second connection member;

wherein the second portion moves between a foldable position and a release position relative to the first portion;

wherein the mounting bracket is configured to be locked in foldable position securing the seat to the base; and wherein the mounting bracket is configured to be in release position for assembly and disassembly of the seat from the base; and wherein the seat is configured to be assembled to the base in an upright position by a user.

2. The apparatus of claim 1, wherein the apparatus is a chair.

3. The apparatus of claim 1, wherein the first portion is configured to be a first plate and the second portion is configured to be a second plate.

4. The apparatus of claim 1, wherein the receiving member is in a U-groove configured to receive the second portion.

5. The apparatus of claim 1, wherein the flexible joint joining the first portion and the second portion comprises a hinge joint.

6. The apparatus of claim 1, wherein the first portion and the second portion are lockable using one of a mechanical locking mechanism and a magnetic locking mechanism.

7. The apparatus of claim 1, wherein the base comprises a hydraulic spring configured for height adjustment forming a hub and one or more legs, wherein the legs are foldable and lockable using a spring loaded pin joint.

8. The apparatus of claim 7, wherein the legs comprise feet of the apparatus which are configured for leveling the apparatus on a floor.

9. The apparatus of claim 1, wherein the apparatus further comprises a backrest, a headrest, and a footrest.

10. The apparatus of claim 9, wherein the backrest is adjustable to one or more reclining positions with respect to the base using a gas spring.

11. The apparatus of claim 9, wherein the backrest is foldable on to the seat to form a closed position, and lockable in the closed position.

12. The apparatus of claim 9, wherein the headrest is adjustable to one or more height positions using a leaf spring mechanism.

13. The apparatus of claim 9, wherein the footrest is adjustable to one or more positions using a spring-loaded pin to lock the footrest in the positions.

14. The apparatus of claim 1, wherein the seat comprises one or more wheels.

15. The apparatus of claim 1 wherein the seat is configured to swivel with respect to the base.

16. The apparatus of claim 1, wherein the base is covered using a base skirt, wherein the base skirt is configured to protect the base from dust and hair trimmings, and wherein the base skirt is detachable.

17. An apparatus comprising:

a seat, a backrest, a base, a footrest, and one or more wheels;

the seat comprising a first side configured for a user to sit, and a second side comprising a member for receiving a second portion of a mounting bracket, wherein the mounting bracket comprises a first portion connected to the base and the second portion that moves between a foldable position and a release position relative to the first portion;

the backrest engaging with the seat such that the backrest is independently reclinable with respect to the seat and being foldable onto the first side of the seat to form a folded position and lockable in the folded position;

the footrest connected to the seat at a first position configured to receive feet of the user when seated; and the wheels connected to at least one of the seat and the backrest at a second position, wherein the second position is at opposite side of the first position such that the footrest is configured to be used as a handle while the wheels are configured to support a weight of the apparatus and facilitate transportability of the apparatus.

18. The apparatus of claim 17, wherein the apparatus further comprises a modular bracket, wherein the modular bracket is configured to hold one or more tools.

19. The apparatus of claim 17, wherein the apparatus further comprises a power socket, wherein the power socket is powered by a detachable extension coil.

20. A method comprising:

unfolding legs such that the legs lie at a first angle to a hydraulic spring configured for height adjustment to form a base of an apparatus, wherein a mounting bracket is attached to the hydraulic spring;

unlocking the mounting bracket, wherein the mounting bracket comprises a first portion, a second portion and a flexible joint joining the first portion and second portion;

sliding a seat assembly onto the second portion of the mounting bracket, wherein the seat assembly comprises a seat attached to a backrest, a footrest, a headrest, and an armrest; and unfolding the backrest and adjusting a second angle of the backrest relative to the seat; and wherein the method is configured for assembling the apparatus; and wherein the apparatus is configured as a chair.

* * * * *